US006640049B1

(12) United States Patent
Lee et al.

(10) Patent No.: US 6,640,049 B1
(45) Date of Patent: Oct. 28, 2003

(54) ION EMITTING HOT AIR BLOWER

(75) Inventors: William Lee, Salt Lake City, UT (US); Shek Fai Lau, Foster City, CA (US)

(73) Assignee: Sharper Image Corporation, San Francisco, CA (US)

( * ) Notice: Subject to any disclaimer, the term of this patent is extended or adjusted under 35 U.S.C. 154(b) by 0 days.

(21) Appl. No.: 09/721,055

(22) Filed: Nov. 22, 2000

(51) Int. Cl.[7] ..... A45D 20/00
(52) U.S. Cl. ..... 392/385; 34/96
(58) Field of Search ..... 392/379–385; 34/96, 97, 90–91; 361/213

(56) References Cited

U.S. PATENT DOCUMENTS

| | | | | | |
|---|---|---|---|---|---|
| 844,300 | A | * | 2/1907 | Chapman | 361/213 |
| 4,258,408 | A | * | 3/1981 | Cantelli | 361/213 |
| 4,829,398 | A | * | 5/1989 | Wilson | 361/213 |
| 4,951,172 | A | * | 8/1990 | Steinman et al. | 361/213 |
| 5,671,321 | A | * | 9/1997 | Bagnuolo | 392/385 |
| 5,805,406 | A | * | 9/1998 | Mailand | 361/212 |
| 6,191,930 | B1 | | 2/2001 | Ramchandani | 361/213 |
| 6,205,674 | B1 | * | 3/2001 | Kaizuka | 34/96 |
| 6,205,679 | B1 | * | 3/2001 | Rodway et al. | 34/487 |
| 2003/0046825 | A1 | * | 3/2003 | Slingo | 34/96 |

FOREIGN PATENT DOCUMENTS

| | | | |
|---|---|---|---|
| FR | 1350890 | * | 12/1962 |
| FR | 2766338 | * | 1/1999 |
| GB | 392873 | * | 5/1933 |
| GB | 2055573 | * | 3/1981 |
| GB | 2067071 | * | 7/1981 |
| JP | 54-40755 | * | 3/1979 |
| JP | 2-98098 | * | 4/1990 |
| JP | 7-335369 | * | 12/1995 |

OTHER PUBLICATIONS

Sharper Image Corporation, *The Sharper Image Catalog*, Model No. SI545, Sep., 2000, 2 pages.
Lifestyle Fascination Catalog, Mid–Summer, 2000, p. 40.
Brookstone Gift Collection Catalog, Nov., 1999, p. 61.

* cited by examiner

*Primary Examiner*—John A. Jeffery
(74) *Attorney, Agent, or Firm*—Fliesler Dubb Meyer & Lovejoy LLP

(57) ABSTRACT

A surplus of preferably positive ions are thermally emitted by a device such as a hair dryer that includes a heating element disposed upstream from an electrically conductive grid. A rectifier circuit is coupled between the heating element and the grid and establishes an electric field therebetween. Polarity of the field affects ion content downstream from the grid. A fan assembly blows heated air and ions toward the conductive grid, whereat ions of one polarity are substantially removed. An ion sensor and feedback circuit may be coupled to the device to sense and control net ion content adjacent the sensor. In a hair dryer device, a net surplus of positive ions promotes grooming and rapid drying of a user's hair.

19 Claims, 5 Drawing Sheets

ION EMITTING HOT AIR BLOWER

FIELD OF THE INVENTION

This invention relates to hot air blower devices that output ionized air, and more specifically to such devices that produce ions without requiring high voltage ionization circuits.

BACKGROUND OF THE INVENTION

Electrically powered hot air blowers have found widespread use, ranging from handheld household devices useful to dry wet hair, to large units that find industrial application. Typically 110–220 VAC is applied across a resistive Nichrome heating element to produce heat. An electric fan then blows heated air from the heating element in a desired direction, e.g., toward one's head in a household hair dryer type device.

It can be advantageous in many applications to output ions along with the heated air. For example, in a hair dryer, ions can beneficially reduce static electricity in the hair that is being dried, to hasten the grooming process. In hair dryer and other applications, an outflow of ions can be useful to sterilize or deodorize. In industrial applications, ions can be used to neutralize electrical charge, for example in a CMOS semiconductor fabrication site.

Applicants' U.S. Pat. No. 5,975,090 (November 1999) entitled "Ion Emitting Grooming Brush" disclosed a cold air hair brush that emits ions using a rather efficient high voltage ionizing circuit. However, by definition, such ion generating devices require circuitry to generate high voltage, typically many kilovolts. Further, such devices require an array of electrodes, across which high voltage is coupled. Although the resultant hair brush produces an outflow of ions, a simpler and less expensive approach is desired for a heating device, for example a hair dryer.

There is a need for a hot air blower device that not only outputs air that is heated, but air that contains ions. Preferably such device should function need for high voltage generation or special electrode arrays. Further such device should permit control over the net polarity of the output ions, preferably by a subtractive process.

The present invention provides such a device.

SUMMARY OF THE PRESENT INVENTION

The present invention utilizes thermionic-like emission rather than high voltage to create an ion-producing environment within a hot air blower device, such as a hair dryer.

In a hot air blower device, the device housing contains a conductive coated heating element across which is impressed operating voltage preferably derived from 110 VAC. When sufficiently heated, the heating element appears to ionize air near the element, and in a preferred embodiment generates substantial amounts of positive ions. A motor operated fan within the device housing blows the heated air and thermally generated ions toward an exit port in the device housing. In the preferred embodiments, the coated heating element comprises first and second coils that be operated such that current flows through both elements in series (LO heat mode), or flows through only one coil (HI heat mode). A user-operable switch permits selecting the LO or HI modes of operation.

According to a preferred embodiment of the present invention, an optional electrically conductive grid or mesh is placed across the device exit port, in a position downstream from the thermally emitted ions. The housing further contains a rectifier circuit that in various embodiments provides half-wave or full-wave rectification of the input 110 VAC. The output of the rectifier circuit is coupled to the conductive grid or mesh such that a positive or a negative charge is impressed upon the grid.

The electric fan air flow forcibly moves the thermally generated ions toward the grid or mesh. Electrical charge coupled to the grid can influence the net charge at and downstream from the grid, and can influence the ionic content of the heated air that exits from the device. For example, if the grid is charged positively, some positive ions in the airstream will be slightly repelled but more negative ions will be neutralized by the charge on the grid, and are essentially subtracted from the output airflow. The result is that the fan created air flow will blow a net of positive ions through the outlet port of the device. If the grid were negatively charged, some negative ions in the airstream would be somewhat repelled and some positive ions would be neutralized by the charge on the grid. Thus, assuming that the nature of the heating coil will generate a net excess of positive ions, the net output flow of ions could still be positive, but with a somewhat reduced positive ion content compared to the above example. In the various embodiments, the result is that the heated air leaving the device exhaust port can have a net surplus of positive ions. If the heating element were coated to generate substantial negative ions, the output airflow could have a surplus of negative ions.

In the various embodiments, a user-operable switch enables high power (greater heat and thus more ion generation) or low power (less heat, less ions) operation of the device.

A preferably cylindrically shaped conductor may be disposed adjacent the heating element, upstream and/or downstream therefrom, and coupled to an appropriate node of the AC power source. The conductor presents a relatively modest electric field near the heater element that can greatly enhance the net outflow of positive ions or negative ions, or indeed substantially equally large numbers of each type of ions. A relatively high positive ion content in the output air flow is desired as it seems to condition a user's hair, and to promote more rapid drying.

In a hair dryer or preferably in an industrial application, feedback may be included to automatically change polarity of charge at the grid to control net ion concentration in the output airflow, including substantially zero ion condition. In some commercial applications, it is desired to direct a stream of neutrally charged heated air at a specimen.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1:
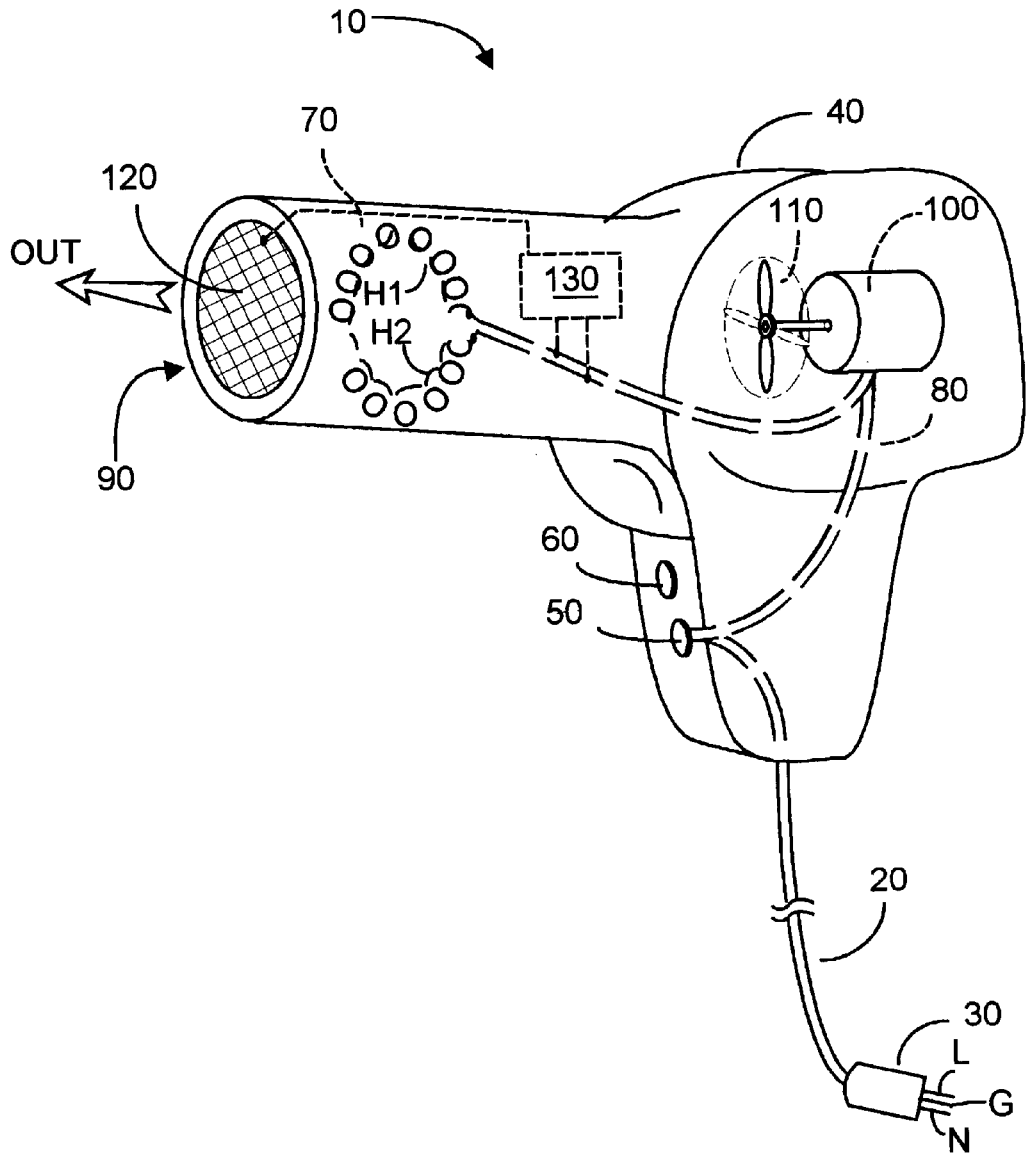
FIG. 1 depicts a hot air dryer embodiment of the present invention.

FIG. 1 depicts a hot air hair dryer 10 with thermionic ion emission, according to the present invention. Dryer 10 receives operating potential via an electrical cord 20 and AC plug 30. Typically plug 30 is coupled to a source of operating potential, e.g., 110 VAC at 50 Hz to 60 Hz, although 220 VAC may be used. As shown, plug 30 has three male blades, denoted L, N, and G (ground).

Dryer 10 includes a typically plastic housing 40, and one or more user-operable controls such as on/off/low/medium/high switch 50 and an optional conditioning/anti-static mode switch 60. Hot air is generated by dryer 10 by a heating element 70, typically a coil of conductive wire to which a coating 75 may be added to affect coil 70's ion-generating ability. In the preferred embodiment, coil 70 is made from a material such as Nichrome, an FeCrAl alloy (e.g., Kanthal), molybdenum disilicide such that when heated, a large qunintity of positive ions is generated thermally.

Coil 70 has an impedance of perhaps 20Ω, although precise impedance magnitude is not critical, and preferably comprises at least two sections denoted H1 and H2. Depending upon the user-position of switch 50, the 110 VAC operating potential will be coupled through H1 and H2 in series, or simply through H2. Less heat and thus fewer ions will be generated by coil 70 when more coil windings are coupled to the operating potential. In practice, sections H1 and H2 may be partially concentric, and more than two section windings may be provided. Further, in practice switch 50 may switch various series and/or parallel combinations of coil windings across the source of operating potentials to achieve different coil heat regimes, and thus different levels of ion generation. For example, combining various coil windings in parallel will lower coil impedance, thus increasing the current flow through the resultant effective coil, with attendant increase in heat and in ion output.

As shown, heating coil 70 is coupled by electrical wires 80 via on/off switch to the source of operating potential (not shown) to which plug 30 is coupled. The air heated by coil 70 is blown or moved downstream toward the device housing outlet port 90 by a fan 100 and fan blade 110 (collectively, a fan assembly). Air may of course enter device 10 via port 90, as well as through one or more openings or vents that may be formed in the housing.

As noted, when operating potential is applied to some or all of coil 70, a large amount of positive ions will be thermally generated and will be directed by the fan assembly downstream and through the outlet port 90. Applicants have found that a net surplus of positive ions can condition a user's hair and indeed promote more rapid drying with device 10 of wet hair.

In a preferred embodiment, dryer 10 is provided with a conductive metal grid or mesh 120 disposed across the outlet port 90, and further includes rectifier circuitry 130, coupled to grid 120 and to the source of operation power, which is to say, coupled to the heating coil 70.

As will be described, rectifier circuitry 130 imposes an electrical charge of chosen polarity upon conductive mesh 120. When operating potential is coupled to coil 70, the coil heats up and thermionically emits a large surplus of positive ions. (If coating 75 were, for example, ceramic, negative ions could also be generated.) Although exact temperature magnitudes are not critical, in a preferred embodiment heating element temperature is about 600° C. to about 1,000° C., and the grid or mesh temperature is about 140° C. As noted, the nature and quantity and relative amount of thermally generated ions appear to be a function of operating potential, resultant temperature, and the constituents and any coating comprising heating element 70. As noted, switching various coil windings into or out of operation can alter current flow through the effective coil, and thus alter coil temperature and ion production.

For example, although a dynamic equilibrium condition will be sought, a nichrome wire heating element will tend to generate more positive ions than negative ions. On the other hand, other heating element materials can product substantially equal numbers of both type ions, perhaps an $MoSi_2$ material. It is possible that the difference in ion production is related to the surface finish of the heating element material. For example nichrome tends to have a shiny surface, whereas $MoSi_2$ tends to have a dull surface. Negative ion production seems to be promoted by coating a coil winding with a non-conductive material, ceramic for example.

In a true thermionic emission, a metal produces ions directly. However in the present invention, it appears that the metal heating element, at sufficiently high temperature, heats adjacent air, which becomes ionized. At a relatively low heating element temperature, it is believed an electron may be released from an oxygen or nitrogen molecule close to the element. Electrons have very low energy but very high mobility, and will tend to be quickly absorbed into the heating element. But at the same time, positive air molecules have much lower mobility in that their mass is tens of thousands of times greater than electron mass. Thus positive air molecules become entrained in the moving air flow, rather than migrating over to contact the heater element. Had such contact occurred, the molecule would have been neutralized with an electron donated by the heater element.

In practice, when switch 50 includes winding portion Hi in the electrical current path, overall coil impedance increases, and element 70 attains a lower temperature. At low heater element temperatures (less than about 500° C.), essentially no negative ions are produced and only a relatively few positive ions are produced. As element temperature rises above about 600° C., production of positive ions increases dramatically, with production of only a relatively few negative ions. Substantial production of negative ions begins to increase dramatically as the element temperatures rises above about 750° C. In general, at all relevant temperatures it appears that more positive ions are produced than negative ions, at least for the preferred materials used for element 70. However, as noted, other element materials can produce fewer positive electrons, and indeed one (or more) winding portion of element 70 might be formed from a material that does not favor thermal generation of positive ions.

Assume that switch 60 causes rectifier circuitry 130 to impose a positive electrical charge upon grid 120 relative to heating element 70. A positively charged grid will establish an electrical field with respect to the heating element. With a positive charge on it, grid 120 will tend to attract negative ions emitted by the heating element, and will tend somewhat to repel positive ions. Although there will be some recombination at the charged grid, the net effect will be a surplus of negative ions in the hot air flow exiting port 90, due to the air stream created by the fan motor and fan blade assembly. (An exemplary airstream flow created by the fan assembly might be about 1,000 feet/min.) A relatively high negative ion content in the air outflow is desired to minimize static on a user's hair subjected to the outflow coming from port 90 of device 10. As such, the user's hair can be easier to comb, as adjacent hairs no longer tend to electrostatically repel one another.

On the other hand, if switch 60 causes circuitry 130 to impose a negative charge on grid 120 relative to heating element 70, the resultant electrical field would attract positive ions and tend to repel negative ions. Even after recombination at the charged grid, the result will now be a net excess of positive ions entrained in the air stream exiting the dryer outlet port. A net surplus of positive ions seems to favor conditioning of a user's hair subject to the ionized air flow from output port 90 of device 10.

It will be appreciated that even without fan 100 and fan blade 110, there will be some migration of ions toward the exit port 90 by virtue of the electric field created between heating element 70 and the charged output grid 120. Understandably, providing a fan increases the outflow velocity substantially.

Having generally described the method of thermionic ion emission utilized in the present invention, specific embodiments of rectifier circuitry 130 will now be described.

Figure 2A:
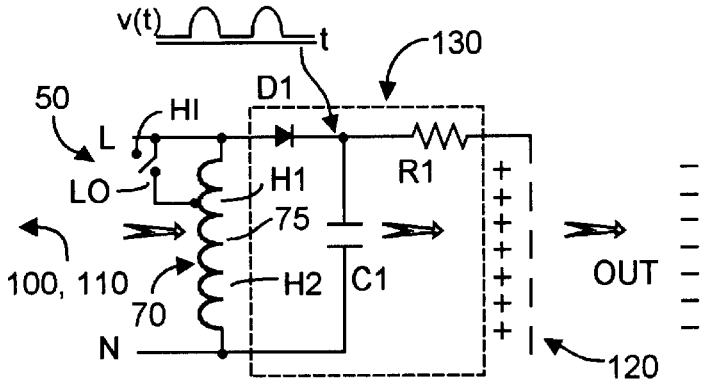
FIG. 2A depicts a half-wave rectification embodiment of the present invention that outputs net negative ions.

FIG. 2A depicts a half-wave rectifier embodiment in which rectifier circuitry 130 comprises a diode D1, a capacitor C1 and a resistor R1. Although component values are not critical, diode D1 must have a breakdown voltage sufficient to withstand a reverse bias of perhaps 300 V. Capacitor C1 is perhaps 500 pF and resistor R1 is perhaps 10 MΩ. Resistor R1 is used as a safety or limiting resistor intended to reduce the hazard of electrical shock should a person touch grid 120. In practice R1 carries essentially no current, perhaps a few pA, and any field voltage across R1 will be negligible.

In FIG. 2A, the "L" and "N" notations shown at the terminals of the heater element 70 refer to the AC voltage source terminals. In a preferred embodiment there will be approximately 120 VAC RMS measured between terminals L and N. For the values shown, at the junction of D1–C1 a half-wave rectified voltage waveform v(t) will be present, having a peak magnitude of about +160 VDC. Resistor R1 permits a slight current flow to exist across the resistor and a net positive charge is impressed upon conductive grid 120. The hollow arrows in the figure denote the flow of heated air and ions.

As shown in FIG. 2A, heater element 70 preferably comprises first and second heater windings, H1 and H2. Each winding H1, H2 has an electrically conductive core such as a wire, and may have a coating 75 over the conductive wire. However, H1 and H2 may have different core diameters and/or different numbers of coil windings. Coating 75 may be a material to help reduce emission of negative ions by heater element 70, or it may be a material to somewhat promote thermal generation of negative ions. In FIG. 2A, it is assumed that the coil material and/or coating is such that thermionic generation of a surplus of negative ions is promoted. Alternatively, depending upon the coil material composition, and/or winding, upon being sufficiently heated by electrical current, element 70 could thermionically emit both positive ions and negative ions, although not necessarily in equal quantities. Fan 100 and fan blade 110 (not shown but to the left in FIG. 2A) will blow air heated by element 70 and positive and negative ions downstream in the direction of the outlet port 90 and charged grid 120. The positively charged grid will tend to attract negative ions, where they will be neutralized, and will tend somewhat to repel other positive ions. However if coil 70 emits sufficient numbers of negative ions, the result is that a net of negative ions will be entrained in the hot air stream blown through grid 120 and out of port 90. This output stream of hot air and ions is denoted "OUT" in the figures. The surplusage of emitted negative ions is shown by the minus signs on the right hand side of FIG. 2A.

If the magnitude of potential at node L were increased and/or if the magnitude of the heating element temperature were increased (e.g., by decreasing coil impedance), acceleration of the emitted ions would result. Decreasing the distance between the heating element and the charged grid will increase the electric field (e.g., volts/distance) and will tend to increase the output flow of net negative ions in FIG. 2A. Increasing R1 provides a greater field voltage across R1, but at the cost of current. In practice R1 had a range of about 1 MΩ to about 10 MΩ.

In a preferred embodiment, the distance separating heating element 70 from grid 120 was about 2 cm and the quantity of net negative ions generated was estimated at perhaps a few million negative ions/cc. It is seen that a relatively large amount of ions of a chosen polarity may be output using a relatively low amount of current through resistor R1, e.g., perhaps 150 $\mu$A (e.g., perhaps 150 V/ 1 MΩ).

Figure 2B:
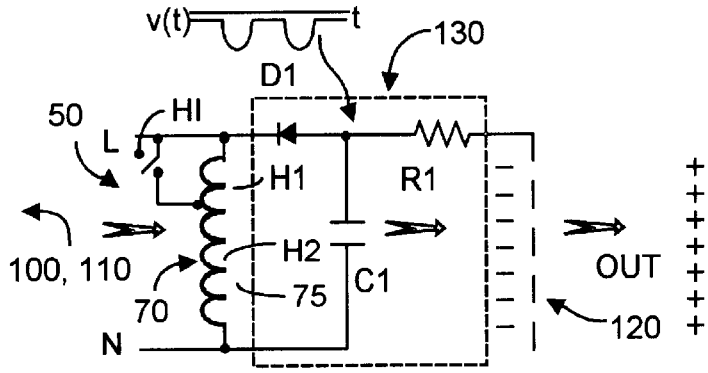
FIG. 2B depicts a preferred embedment in which half-wave rectification results in an net positive ion output airflow, according to the present invention.

Assume that switch 60 is configured to permit a user of dryer 10 to reconfigure circuitry 130 to now change polarity of the potential coupled to grid 120. Comparing FIG. 2B with FIG. 2A it is seen that simply inverting D1 with switch 60 will now impress a negative potential on grid 120. FIG. 2B is in fact an especially preferred embodiment in that it outputs a net surplusage of positive ions, e.g., ions whose polarity applicants have found to be desirable in conditioning a user's hair, and in promoting more rapid drying of a user's hair. In FIG. 2B, element 70 includes a material such as nichrome that, when suitably heated, generates a net surplus of positive electrons. Some of the generated positive ions will be cancelled out due to negative ions at grid 120, and (if present) some negative ions may tend to be repelled by the positive charge on grid 120. However the air stream created by the fan assembly is sufficiently strong to pass a net surplus of positive ions through grid 120, and out of device 10.

Figure 2C:
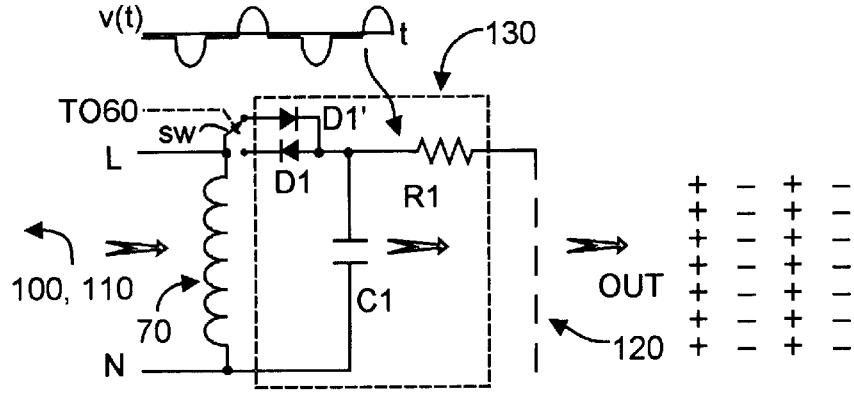
FIG. 2C depicts a half-wave rectification embodiment of the present invention that dynamically outputs net positive and net negative ions.

Turning now to FIG. 2C, circuitry 130 can include an electronic switch SW to augment and/or replace grid polarity switch 60. For ease of illustration, FIGS. 2C–2I do not depict switch 50, or sub-windings of element 70, or any optional coating 75. In FIG. 2C, an electronic switch SW (e.g., one or more MOS devices) can enable polarity of diode D1, D1' to switch periodically, for example at the supply voltage frequency 50 Hz or 60 Hz, or some other frequency, perhaps a few Hz. Such a configuration would result in a net output of positive ions then negative ions then positive ions, etc. Substantially equal quantities of ions would thus be output, sequentially, regardless of switch duty cycle. If desired, switch 60 could be used to trigger such sequential output bursts of positive and of negative ions. Electronic switch SW could be programmed to alternate diode polarity in one of a chosen number of operating regimes. For example, in a hair brush application, one such regime might be to promote passage of positive ions (which can be beneficial to hair) for say two minutes, and then promote passage of negative ions (to tend to neutralize static electricity in the hair) for perhaps ten seconds. Of course other duty cycles between positive ion generation and negative ion generation may be provided.

If desired, switch SW can simply be a mechanical switch, coupled to switch 60. Such a mechanical switch SW would permit a user to determine whether the present output of heated air is rich in positive ions or in negative ions.

Figure 2D:
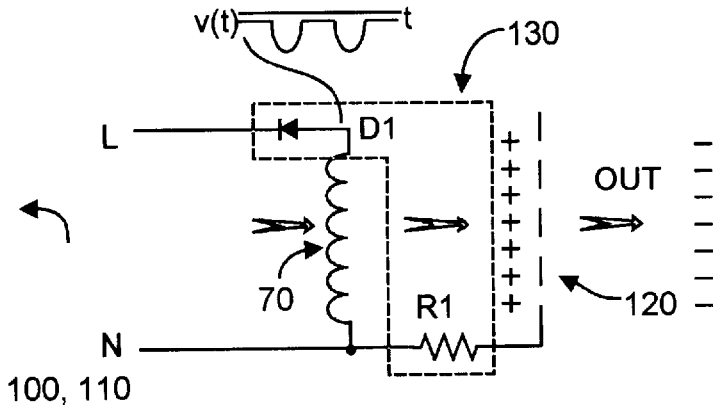
FIG. 2D depicts a second half-wave rectification embodiment of the present invention that outputs net negative ions.

FIG. 2D depicts another embodiment of a half-wave rectifier circuit in which a positive potential is impressed upon grid 120, and wherein coil 70 emits a net surplus of negative ions, resulting in emission of net negative charges through grid 120. Note that inclusion of D1 in series with power to the heating element will result in somewhat cooler emission temperature, as some power is dissipated in D1. Resistor R1 is optional and is shown omitted in companion FIG. 2E.

Figure 2E:
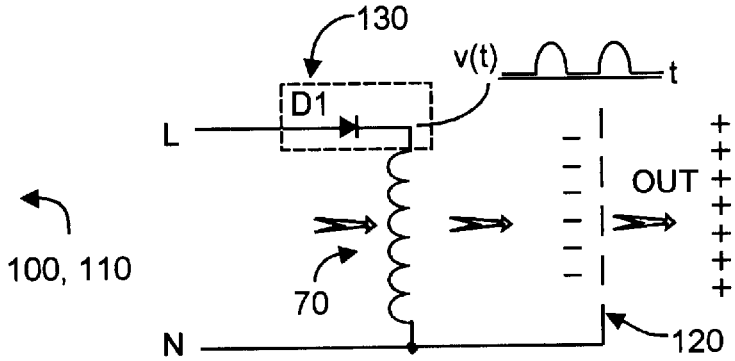
FIG. 2E depicts a second half-wave rectification embodiment of the present invention that outputs net positive ions.

FIG. 2E is somewhat similar to that of FIG. 2D except that coil 70 emits a net surplus of positive ions, resistor R1 is eliminated, and polarity of the voltage impressed on grid 120 is negative. Thus, FIG. 2E outputs a heated air stream entrained with net positive ions. The bias configurations of FIGS. 2D and 2E are less favored than that of FIGS. 2A–2C because these circuits are less balanced and exhibit a poor power factor. It is understood that dynamic diode switching and/or user-control over ion output polarity may be provided, using techniques similar to that shown in FIG. 2C for example.

Figure 2F:
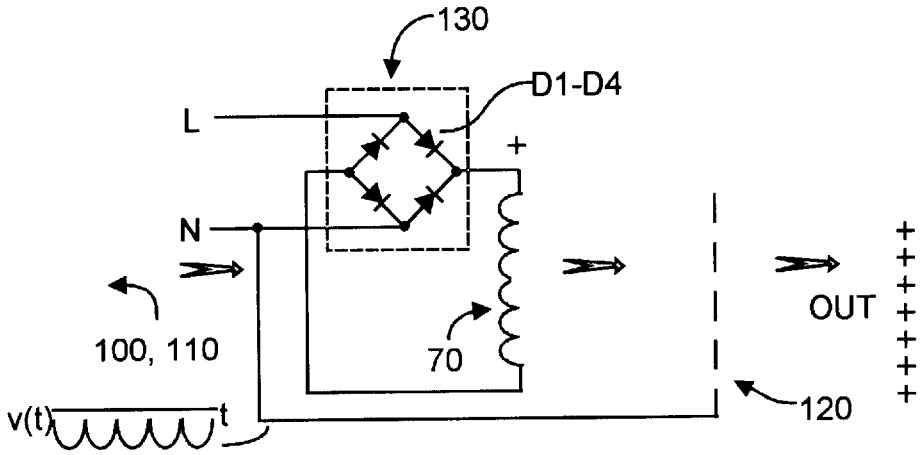
FIG. 2F depicts a full-wave rectification embodiment of the present invention that outputs net positive ions.

FIG. 2F depicts a full-wave embodiment of rectifier circuit 130, comprising four diodes D1–D4, wherein coil 70 emits a net surplus of positive ions. In this configuration, a voltage of about −160 V (with ripple) is impressed upon grid 120, assuming a nominal 115 VAC input operating potential. In this fashion, a net of positive ions is entrained in the flow of heated air emitted from outlet port 90.

Figure 2G:
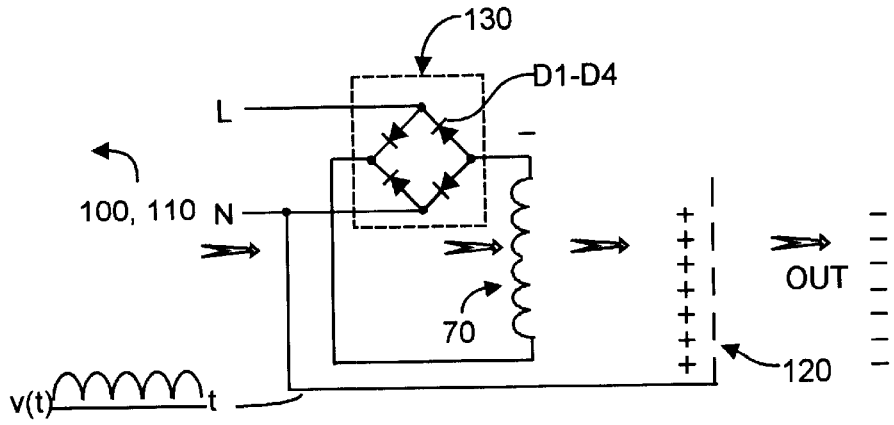
FIG. 2G depicts a full-wave rectification embodiment of the present invention that outputs net negative ions.

FIG. 2G is similar to FIG. 2F except that coil 70 emits a net surplus of negative ions, and polarity of the full-wave diode bridge has been reversed. In this configuration, a positive potential (here about +160 V) is impressed upon the grid and the entrained output flow of heated air will be rich in negative ions.

If desired, the embodiments of FIGS. 2F and 2G may be combined dynamically using switches to reconfigure the diode bridge. The result would be similar to what was described with respect to FIG. 2C. A user could intentionally select to bias the grid with a chosen polarity using, for example, switch 60 to activate an electronic or even mechanical switch to reconfigure the diode bridge. Alternatively, the diode bridge could, controllably, be caused to alternate in polarity between positive and negative. It will be appreciated that the configurations of FIGS. 2F and 2G are balanced and will exhibit a better power factor than the configurations of FIGS. 2A–2E.

Figure 2H:
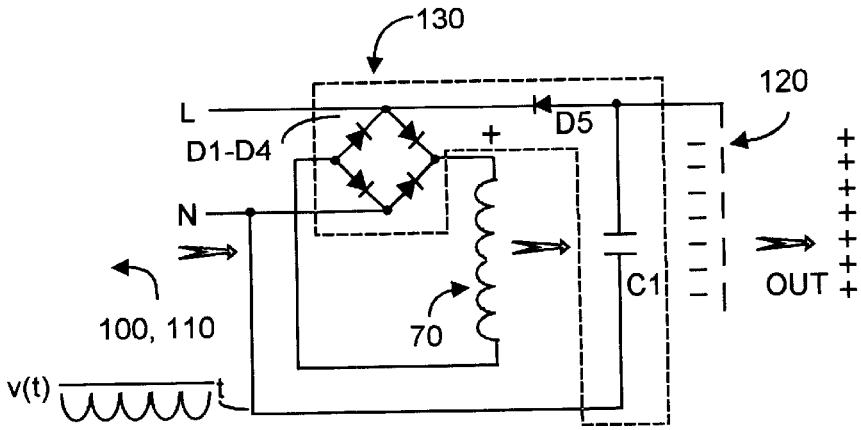
FIG. 2H depicts a second full-wave rectification embodiment of the present invention that outputs net positive ions.
Figure 2I:
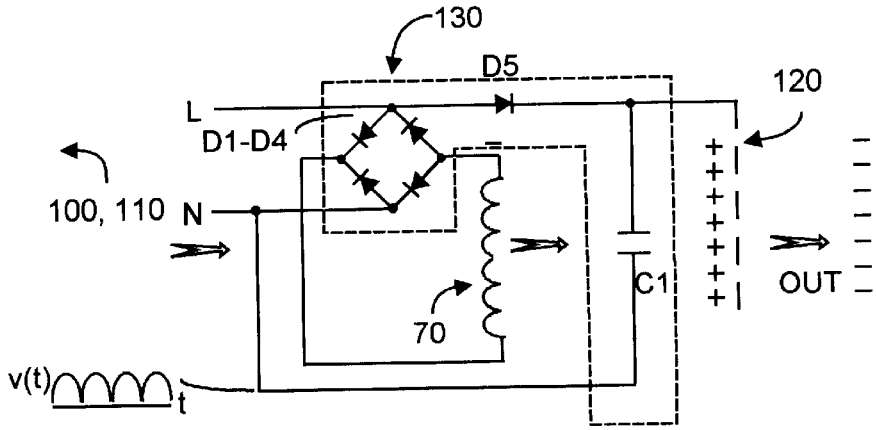
FIG. 2I depicts a second full-wave rectification embodiment of the present invention that outputs net negative ions.

The full-wave rectification configuration of FIG. 2H provides better rectification than the full-wave rectifier embodiments of FIGS. 2F and 2G. In FIG. 2H, coil 70 emits a surplus of positive ions, and rectifier circuit 130 includes a fifth diode, D5, and a capacitor C1, again having a value of perhaps a few hundred pF. A negative voltage of about −160 V is impressed upon grid 120, which as earlier described causes the outflow of heated air to be entrained with a net of positive ions. The configuration of FIG. 2I is similar except that coil 70 emits a surplus of negative ions, and polarity of the diode bridge comprising D1–D4 and the fifth diode, D5, is reversed. In this configuration, a positive potential is impressed upon grid 120, and the result is an outflow rich in negative ions. The embodiments of FIGS. 2H and 2I can provide a larger field strength than the embodiments of FIGS. 2F and 2G, and provide a more efficient ion generator.

As with the other embodiments described, if desired the various diodes in FIG. 2H can be reconfigured using mechanical or electronic switches to realize the configuration of FIG. 2I. As such, if switch 60 is coupled to circuitry 130, a user can select whether to output a net of positive or negative ions.

Figure 3:
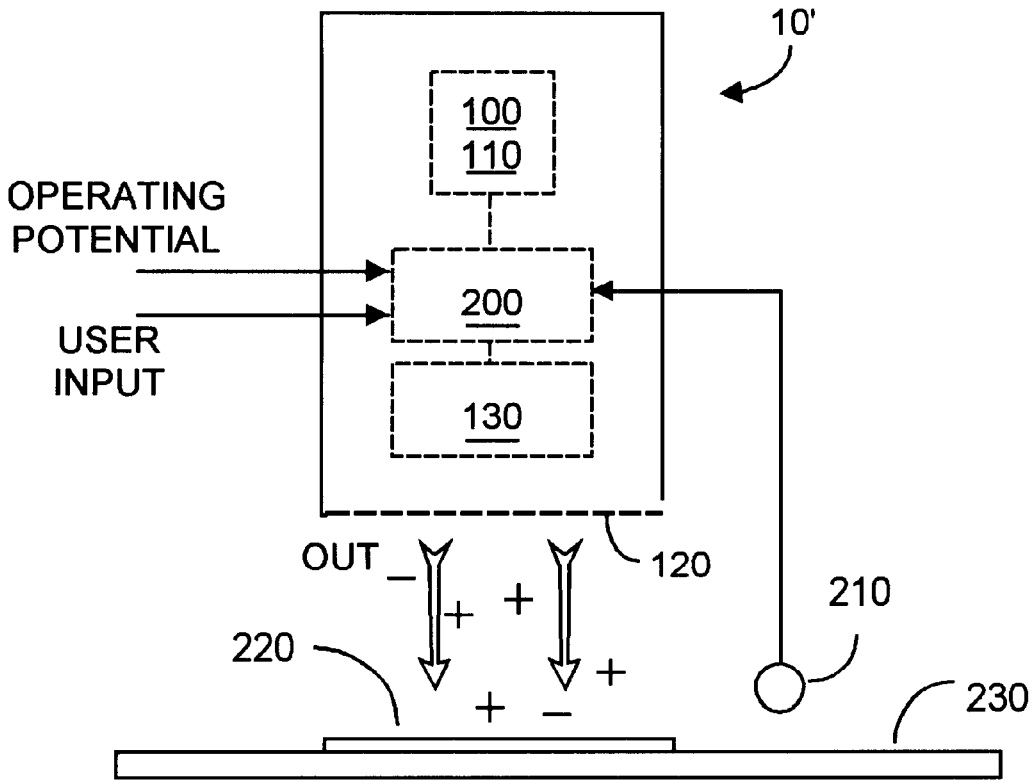
FIG. 3 depicts an embodiment of the present invention incorporating feedback to generate a controlled quantity of ions.

Although the present invention has thus far been described with respect to use with a dryer type device, other applications are possible. In FIG. 3, the present invention, depicted as 10', includes feedback circuitry 200 coupled to an ion detector 210. In this embodiment, the present invention is used to subject a specimen 220, shown supported on a substrate 230, with a controlled flow of ions of a chosen polarity. Although FIG. 3 depicts a net positive ion condition, it is understood that the outflow of heated air could include a net of negative ions, or indeed a controlled output with substantially zero ions net. Specimen 220 may, for example, be a semiconductor substrate such as a CMOS wafer, and it may be desired to subject the specimen to an ion free environment. (If the specimen is not to be subjected to excess heat, device 10' could include a cooling system near the output charged grid 120.)

In this embodiment, ion sensor 210 quantifies ions present adjacent substrate 220 and couples such data to circuit 200. Circuit 200 then compares this input data representing actual ion content against a user-set parameter representing desired ion content. As noted, desired ion content may be net positive ions of a certain concentration, net negative ions of a certain concentration or substantially no ions. The user-input shown in FIG. 3 may represent input data in the form of a controlled reference voltage used in a comparison with a signal from sensor 210. If desired, user-input may be in the form of digital commands from a computer or signals from a memory representing a known desired ion condition at the specimen.

Feedback circuit 200 may then control parameters within rectifier circuit 130 to regulate the present output state of ion production. For example, if net positive ions are being output but are low in concentration, feedback circuit 200 can cause more operation potential, and/or greater effective duty cycle, and/or higher temperature for heating element 70 until sensor 210 reports that the desired condition is established. By effective duty cycle it is meant that a one-shot or silicon controlled rectifier like turn-on condition may be implemented to provide a voltage waveform that is a fraction of what was depicted in the figures herein. In any event, once the desired ion output state is achieved, device 10' would seek to hold steady-state equilibrium.

On the other hand if ions of the opposite polarity are desired, feedback system 200 can cause circuitry 130 to reconfigure to output net ions of the desired polarity. Thereafter feedback system 200 would maintain the output ion production in a desired state by varying power supply voltage, effective duty cycle, heating element temperature, or any combination thereof.

By the same token, if the environment adjacent specimen 220 has a surplusage of ions of either polarity, device 10' can function to neutralize such ions by outputting a proper amount and concentration of ions of the opposite polarity. In this fashion an essentially ion-free environment adjacent specimen 220 can be established and maintained.

Modifications and variations may be made to the disclosed embodiments without departing from the subject and spirit of the invention as defined by the following claims.

What is claimed is:

1. A thermionic ion emitting device, comprising:

a heating element, coupled in use to a source of operating potential such that said heating element heats the air and thermally creates at least one of positive ions and negative ions;

means for moving thermally created said ions and said heated air in a direction from said heating element out of said device;

an electrically conductive member disposed in a downstream direction from said heating element;

means for establishing an electric field of a desired polarity between said heating element and said member; and means for changing polarity of said electric field;

wherein polarity of said field affects a net positive or negative polarity of ions moved out of said device; and wherein, upon leaving said device a temperature of each of said heated air and thermally created said ions is less than 1200 degrees F.

2. The device of claim 1, further including a switch to select polarity of said electric field.

3. The device of claim 1, wherein said member includes an electrically conductive mesh.

4. The device of claim 1, wherein said member includes an electrically conductive grid.

5. The device of claim 1, wherein said means for establishing includes a rectifier circuit coupled in part between said heating element and said member.

6. The device of claim 1, wherein said means for establishing includes a rectifier circuit coupled in part between said heating element and said member, said rectifier being selected from a group consisting of (a) a full-wave rectifier, and (b) a half-wave rectifier.

7. The device of claim 1, further including:

an ion sensor, disposed in a downstream region from said member; and a feedback circuit, coupled to said ion sensor and to said at least one of said means for establishing, and said source of operating potential, regulating ion content adjacent said ion sensor.

8. The device of claim 1, wherein said means for establishing includes at least one of (a) a diode, (b) a resistor, (c) a capacitor, (d) a user-operable mode switch, and (e) a solid state switch.

9. An ion emitting dryer for drying human hair, comprising:

a dryer housing having at least an outlet port;

a heating element disposed within said housing and coupled in use to a source of operating potential such that said heating element thermally creates at least one of positive ions and negative ions;

an electrically conductive member disposed in said outlet port, downstream from said heating element;

means for establishing an electric field of a desired polarity between said heating element and said member, said means for establishing disposed within said housing; and means for changing polarity of said electric field;

wherein said polarity between said heating element and said member influences net positive or negative ion polarity downstream of said member.

10. The dryer of claim 9, further including a fan assembly, disposed in said housing, creating an airflow in a direction from said heating element toward said member.

11. The dryer of claim 9, wherein said member includes at least one of (a) an electrically conductive mesh, and (b) an electrically conductive grid.

12. The dryer of claim 9, wherein said means for establishing includes a rectifier circuit coupled in part between said heating element and said member.

13. The dryer of claim 9, wherein said means for establishing includes a rectifier circuit coupled in part between said heating element and said member, said rectifier being selected from a group consisting of (a) a full-wave rectifier, and (b) a half-wave rectifier.

14. The dryer of claim 9, wherein said means for establishing includes at least one of (a) a diode, (b) a resistor, and (c) a capacitor, (d) a user-operable mode switch, and (d) a solid state switch.

15. A method of thermally generating ions of a desired polarity, comprising the following steps:

(a) electrically heating an element that when hot generates at least one of positive ions and negative ions;

(b) disposing a conductive member in a downstream direction from said element; and (c) coupling a rectifier circuit between said element and said conductive member such that a potential of a desired polarity is established on said conductive member relative to said element, including reconfiguring relative polarity between said element and said member, said reconfiguring being carried out in a manner selected from a group consisting of (i) dynamic reconfiguration, and (ii) static reconfiguration;

wherein said polarity affects a net positive or negative ion content in a downstream direction from said conductive member.

16. The method of claim 15, further including:

(d) providing an ion sensor downstream from said member; and (e) providing feedback means, coupled between said ion sensor and at least one of said rectifier circuit and a source of operating potential coupled, in use, to said element, for regulating ion content adjacent said ion sensor.

17. An ion emitting hot air blower, comprising:

a housing having at least one inlet and one outlet;

a heating element disposed in said housing, for heating the air traveling from said inlet to said outlet and emitting ions when heated, wherein a temperature of said heated air at said outlet is less than 450 degrees F.;

means for moving the heated air and ions downstream and towards said outlet;

means for establishing a variable polarity electric field disposed between said heating element and said outlet; and means for changing polarity of said electric field;

wherein, polarity of said electric field controls a net positive or negative polarity of ions at said outlet.

18. An ion emitting hot air blower of claim 17, wherein said heating element is a Nichrome wire.

19. An ion emitting hot air blower of claim 18, wherein said Nichrome wire is heated to a temperature between 600° C. and 1000° C. in order to emit ions.

* * * * *